US006565086B2

(12) United States Patent
Williams et al.

(10) Patent No.: US 6,565,086 B2
(45) Date of Patent: May 20, 2003

(54) PUSHER AMUSEMENT MACHINE

(75) Inventors: Geoffrey Williams, Lawrenceville, GA (US); Colin Kirby, Margate (GB)

(73) Assignee: Brandmakers, Inc., Lawrenceville, GA (US)

( * ) Notice: Subject to any disclaimer, the term of this patent is extended or adjusted under 35 U.S.C. 154(b) by 0 days.

(21) Appl. No.: 09/861,482

(22) Filed: May 18, 2001

(65) Prior Publication Data

US 2002/0014739 A1 Feb. 7, 2002

(51) Int. Cl.[7] ..... A63F 7/02

(52) U.S. Cl. ..... 273/138.1; 273/274; 273/454; 453/15

(58) Field of Search ..... 273/138.1, 138.2, 273/274; 453/1–2, 15, 16, 17

(56) References Cited

U.S. PATENT DOCUMENTS

| | | | |
|---|---|---|---|
| 4,662,636 A | 5/1987 | Crompton | |
| 5,507,490 A | 4/1996 | Hagiwara | |
| 5,752,699 A | 5/1998 | Crompton et al. | |

FOREIGN PATENT DOCUMENTS

| | | | |
|---|---|---|---|
| EP | 0767447 A2 | | 4/1997 |
| EP | 0964373 A2 | | 12/1999 |
| EP | 0965963 A2 | | 12/1999 |
| GB | 2293774 A | | 4/1996 |
| GB | 2311734 A | * | 8/1997 |
| GB | 2338578 A | | 12/1999 |
| WO | WO 9742611 A1 | | 11/1997 |

* cited by examiner

*Primary Examiner*—Benjamin H. Layno
*Assistant Examiner*—Vishu K Mendiratta
(74) *Attorney, Agent, or Firm*—Craig A. Fieschko, Esq.; DeWitt Ross & Stevens S.C.

(57) ABSTRACT

A coin operated amusement machine of the "pusher" type has means for providing a mystery payout to the user, a mechanism for diverting coins either to the user directly as winnings or back into the playing loop, means for influencing the ratio of winning and losing coins and a plurality of ways to enter coins into the machine.

16 Claims, 3 Drawing Sheets

PUSHER AMUSEMENT MACHINE

FIELD OF THE INVENTION

The present invention relates to a pusher amusement machine of the type including a platform carrying a plurality of coins over which moves a reciprocating wall or "pusher" which operates to push coins over the edge of the platform to constitute winnings for a player.

BACKGROUND OF THE INVENTION

The term "coin" as used in this specification includes tokens or any other suitable playing pieces.

Pusher machines have been proposed in which, to improve the play appeal and player participation, the player does not necessarily have to insert coins individually nor to collect winnings throughout a playing session. Coins leaving the playing platform are collected separately from coins to be dispensed to the player as winnings. This involves a circulating loop of coins. For example, GB-A-2,303,309 (Cromptons Leisure Machines Ltd.) discloses an amusement machine in which the coin dispenser, the play area, the counting hopper (for counting winning coins) and the escalator hopper (for transferring coins from the counting hopper to the coin dispenser) form a closed loop for recirculation of the coins internally in the machine.

GB-A-2,293,774 (Hunt) discloses a pusher machine in which a coin entered in a slot falls directly onto the play area and gives the player one credit which can be utilized by the player to release a coin from a coin release mechanism onto the play area. In addition, a multi-coin validator is provided into which coins of any denomination can be inserted to give the player an appropriate number of credits which allow a corresponding number of coins to be released from the coin release mechanism. Coins fall from the play area into winning or losing outlets. Winning coins fall into a tray for collection by the player and losing coins are either recirculated to the coin release mechanism by an escalator hopper or are collected in a cash tray. One problem with this machine is that the total number of coins on the playfield can quickly become excessive, leading to the risk of blockages occurring.

U.S. Pat. No. 4,662,636 (Crompton Machine Company Ltd.) relates to a pusher amusement machine in which a randomly moving slide provides an alternative route for a coin entered into the machine to reach the win chute. If a coin falls down the slide, then a bonus payout is made to the player, the amount of which depends on the mount shown on a roulette wheel at the time the coin passes a sensor on the slide.

Other amusement machines are disclosed in GB-A-2,192,802 (Crompton Machine Company Ltd.), WO 82/04340 (Raha-Automaatiyhdistys) and GB 2,343,849A (K.W. Machines Ltd.).

SUMMARY OF THE INVENTION

The present application seeks to provide amusement machines with alternative or improved features to the prior art machines.

In accordance with a first aspect of the present invention, there is provided a coin-operated amusement machine, comprising a play area for the coins, means for introducing coins onto the play area, a first route for coins leaving the play area which coins are designated winning coins, a second route for coins leaving the play area which coins are designated losing coins, means defining a loop for circulating coins to and from the play area, and an outlet for coins to be provided to the user as winnings, wherein the machine additionally comprises a diverter to divert said winning coins either to said loop or to said outlet.

The coin diverter mechanism may be located between the play area and the input of an escalator hopper. In this embodiment, coins which fall from the play area as winning coins are transferred to the coin diverting mechanism (preferably after being counted) and can either be diverted to the escalator hopper or directly to the user as winnings (for example, via a pay-out tray).

The machine preferably includes means (such as software) to keep track of the number of coins on the playfield, so that coins can be diverted into the pay-out cup when the level of coins on the playfield is too high. In this manner, excess coins on the playfield are removed from the "loop" and paid to the user directly The actual time of the instant pay-outs is preferably determined randomly (for example by the machine's software), although the pay-outs only occur when the number of coins on the playfield is above a pre-set level. This randomness means that the user will not be able to anticipate whether he will receive his winnings as credits or as coins deposited directly from the playfield into the pay-out cup. This "mystery pay-out" element is a particularly attractive commercial feature.

In a second aspect of the invention, there is provided a coin-operated amusement machine, comprising a play area for the coins, means for introducing coins onto the play area, a first route for coins leaving the play area which coins are designated winning coins, a second route for coins leaving the play area which coins are designated losing coins, and means defining a loop for circulating coins to and from the play area, wherein means are provided for influencing the ratio of coins leaving the play area by the first and second routes.

In a preferred embodiment, the machine comprises means for fully or partially blocking said first or second route, in order to increase the number of coins leaving the play area by means of said second or first route respectively, such as doors or arms for opening and closing the win and/or lose chutes.

Preferably, an outlet is provided for coins to be provided to the user as winnings.

A third aspect of the invention provides a coin-operated amusement machine, comprising a play area for coins, means for introducing coins onto the play area, a first route for coins leaving the play area which coins are designated winning coins, a second route for coins leaving the play area which coins are designated losing coins, and means defining a loop for circulating coins to and from the play area, wherein the machine additionally comprises a reservoir for coins, means for counting the number of winning coins, and a diverter for diverting both winning and losing coins either to said loop or to said reservoir. Preferably, the machine comprises an outlet for coins to be provided to the user as winnings, and coins from the reservoir are preferably provided to said outlet as winnings.

According to a further aspect of the present invention there is provided a pusher amusement machine including means defining a loop for circulating coins to and from a play area of the machine, means for introducing additional coins into said loop, and means for removing from said loop a number of coins corresponding to the number of coins introduced by said introducing means.

In preferred embodiments, the coin removing means or the diverter is only operated intermittently when the machine is not being played and is standing idle.

Coin counting means are preferably connected to the coin introducing means and the coin removing means so that the same number of coins are removed as have been inserted since the preceding coin removal.

The coin removing means preferably comprises a coin diverter mechanism which transfers coins out of the loop, for example to a pay-out hopper or a cash box of the machine.

In one embodiment, the coin diverter mechanism is conveniently located at the output of an escalator hopper mechanism which itself receives coins leaving the play area. At the top of the escalator hopper, the coins may be diverted out of the loop (for example into a pay-out hopper) or retained in the loop, depending on the need to reduce the total number of coins in the loop.

The present invention also seeks to provide a money pusher machine with alternative modes of play.

According to a fourth aspect of the invention, there is provided a coin-operated amusement machine, comprising a play area for the coins, a coin reservoir, means for directing coins from the reservoir to the play area, a first coin entrance from which coins are directed substantially directly to the play area and a second coin entrance from which coins are directed to the reservoir, means for determining the value of coins entered into the second entrance, thereby calculating the credits available to the user, and an actuator for operation by the user to direct coins to the value of said credits from the reservoir to the play area, characterized in that coins entered into the first entrance do not give the user any such credits.

A preferred embodiment of the present invention has two input devices, e.g. an electronic coin validator as disclosed in the earlier application, and means for introducing additional coins in the form of an "instant play" coin slot, via which an inserted coin passes directly to the play area. Thus a player can use the machine with "push button play", in which coins can be introduced into play in quick succession without the need for separate manual insertion, or "instant play".

In one embodiment, coins are only paid to the user directly from the playfield when the user has entered coins into the machine through an input device which does not transfer the coins directly onto the playfield, such as the electronic coin validator described above.

According to yet a further aspect of the present invention there is provided a pusher amusement machine including first coin receiving means, which supplies inserted coins to a reservoir which allows the coins, or a number of coins corresponding to the inserted number, to be directed to a play area by subsequent actuation of an operating member, and second coin receiving means, which supplies coins substantially directly to said play area.

The pusher machine of the present invention is preferably of the type disclosed in GB 5 2,343,849A (incorporated by reference herein). It may have any combination of the features defined above.

BRIEF DESCRIPTION OF THE DRAWINGS

A preferred embodiment of the present invention will now be described, by way of example only, with reference to the accompanying drawings, in which.

DETAILED DESCRIPTION OF PREFERRED EMBODIMENTS OF THE INVENTION

The Figures show schematically the relevant parts only of a pusher amusement machine. The remaining parts are similar to those disclosed in GB 2,343,849A.

Figure 1:
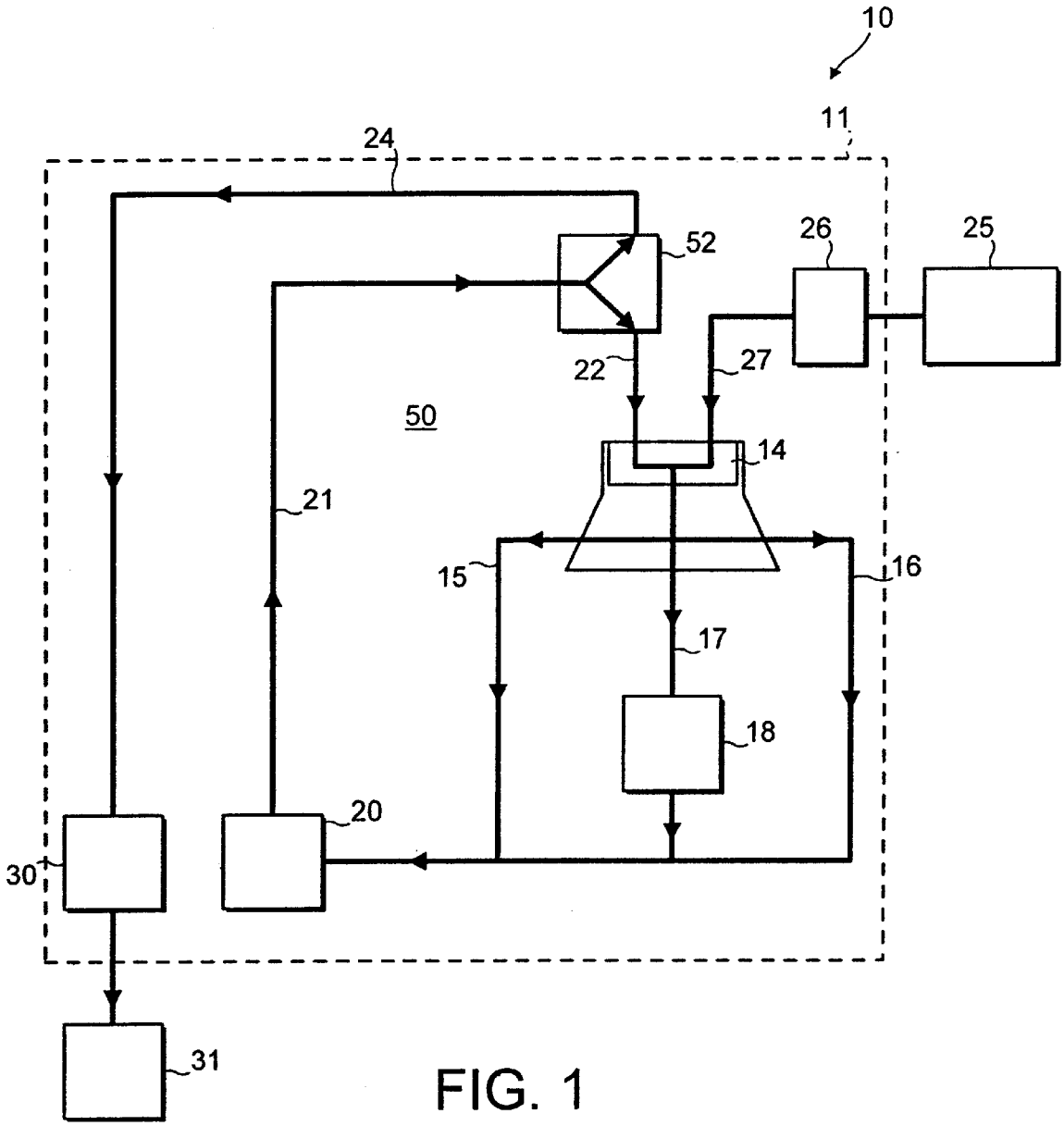
FIG. 1 shows a schematic representation of an embodiment of a pusher amusement machine in accordance with the invention.

Referring to FIG. 1, a pusher amusement machine 10 comprises a cabinet 11, indicated in broken lines. The machine has a pusher playfield or play area 14 of the type including one or more platforms and associated reciprocating walls which, as coins are introduced to the playfield, selectively push coins off the play field towards "lose" outputs 15, 16 or to a win output 17. Coins passing to "lose" outputs 15, 16 pass straight to an escalator hopper 20. Coins passing to win output 17 pass through a coin count hopper 18 on their path to escalator hopper 20. The coin count hopper 18 counts the total number of coins won in a particular session by a player, and stores this value in a software memory of the machine.

Escalator hopper 20 serves as an intermediate reservoir of coins and ensures that a complete vertical stack of coins 21 is maintained ready to feed coins back in at the top of the machine. Each time a player actuates a push button (not shown), the escalator hopper mechanism causes the stack 21 to advance by a single step and a coin is passed via path 22 to enter the playfield. The pushbutton mechanism is as described in GB 2,343,849A and is enabled by inserting coins into an electronic coin validator (not shown), which awards a corresponding number of game credits. Coins leaving the coin validator pass to a pay-out hopper 30 or cash box. At the end of a playing session, a player operates a "collect" button (not shown) which causes pay-out hopper 30 to dispense the appropriate number of coins into a pay-out tray 31.

Thus it will be seen that the playfield 14, coin paths 15, 16, 17, escalator hopper 20, stack 21 and path 22 form a loop 50 of circulating coins.

A feature of the present invention is that an additional slot 25 is provided for the entry of coins. Coins inserted into slot 25 are counted at 26 and then pass immediately via path into the playfield 14. This provides the opportunity for instant play which is an attractive alternative mode of playing the machine, instead of or in addition to pressing 20 the push button to release a coin into path 22.

However, as play proceeds, coins inserted via slot 25 gradually accumulate in loop 50. Without special measures being taken, the loop would eventually overflow and the machine would become blocked. One option is to periodically remove coins manually, preferably from escalator hopper 20, but this is time-consuming and can give additional opportunities for theft. Instead, the present embodiment has, located between paths 21 and 22, a coin-diverter mechanism 52, which operates as follows.

The machine 10 has software which is programmed such that, when the total of coins 30 counted at 26 equals (or exceeds) a predetermined value, the coin diverter mechanism 52 switches the flow of coins from the stack 21 away from path 22 to a separate path 24 to the pay-out hopper 30. The escalator hopper is then actuated to deliver coins to hopper 30, the number of coins delivered being equal to the number of coins counted at 26. When the correct number of coins has been delivered to the pay-out hopper 30, the counter 26 resets to zero and the coin-diverter mechanism switches back to path 22 for normal operation. Thus the total number of coins circulating in loop 50 is maintained substantially constant. This "coin dumping" operation does not take place when the machine is being played, and so the machine software ensures that the operation is enabled only when the machine is standing idle. In the event of electrical power being disconnected from the machine, the number of instant play coins counted at 26 is retained in the memory until power is restored.

An advantage of the above-described machine is that coins can be introduced in an additional playing mode without the need for regular intervention to prevent the machine becoming blocked. Excess coins in pay-out hopper 30 are fed directly to the cash box of the machine.

Instead of path 24 leading to the pay-out hopper 30 it could lead to a separate cash-box (not shown). In another modification, a plurality of separate "instant play" slots 25 can be provided, either with individual or a common counter 26. The memory and control functions can be configured in hardware rather than software if desired.

Instead of escalator hopper 20 and 21, any convenient transfer mechanisms may be used to move coins around the machine.

Figure 2:
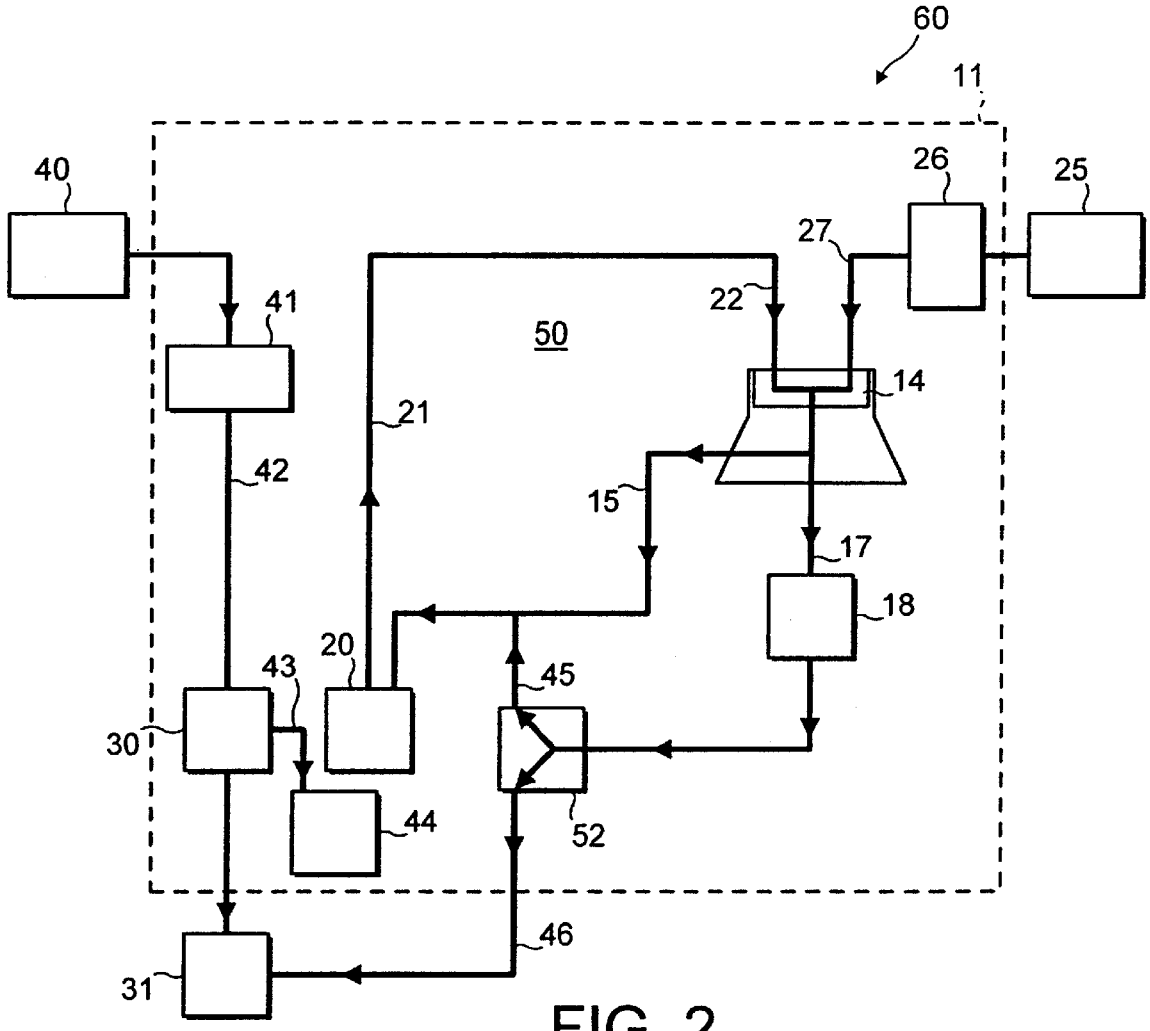
FIG. 2 shows a schematic representation of an alternative embodiment of a pusher amusement machine in accordance with the invention.

FIG. 2 shows an embodiment of pusher amusement machine 60 which has a number of features in common with machine 10 shown in FIG. 1. These features are identified with like numbers to those used in FIG. 1 and can be assumed to function in the same manner unless otherwise indicated.

In the machine 60 of FIG. 2, coin diverting mechanism 52 is located between coin count hopper 18 and escalator hopper 20. In normal operation, coin diverting mechanism 52 transfers winning coins from coin count hopper 18 to escalator hopper 20 via path 45, i.e. the coins remain in loop 50. However, when the number of coins in loop 50 reaches a pre-set level (as a result of coins being added to play area 14 through slot 25), coin diverting mechanism diverts coins directly to pay-out tray 31 via path 46.

This embodiment therefore reduces the number of coins in loop 50 by diverting winning coins directly to the user as an instant win. This mode may be called "mystery pay-out" or "mystery win" mode, since it will be apparent that the machine's software can introduce an element of randomness so that the user cannot anticipate when winnings are going to be paid directly.

"Losing" coins are transferred directly from lose output 15 (and 16 not shown) to 15 escalator hopper 20 as in the embodiment of FIG. 1.

FIG. 2 also depicts coin slot 40 which directs coins to coin validator 41 and thence to pay-out hopper 30 via path 42. Entering coins into machine 60 via slot 40 gives the user credits which can be used to eject coins from vertical stack 21 onto play area 14 via path 22, as described above.

Coins are transferred from pay-out hopper 30 to cash box 44 via overflow 43 when payout hopper 30 is too full.

Figure 3:
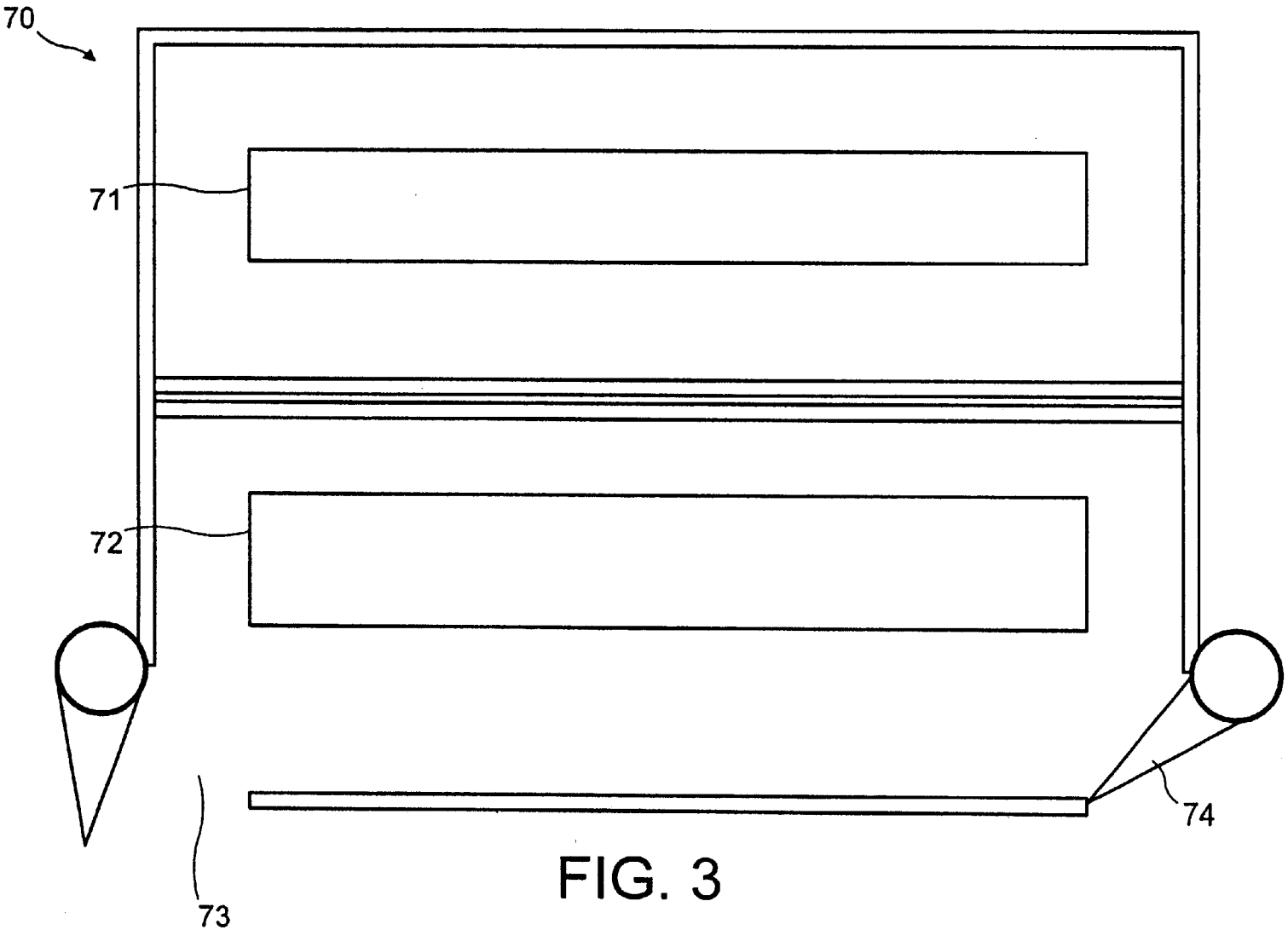
FIG. 3 is a schematic depiction of apparatus for controlling percentage payout in accordance with the invention.

FIG. 3 depicts schematically part of an amusement machine 70 in accordance with the invention, having upper coin deck 71 and lower coin deck 72 with two lose outputs 73 leading from lower coin deck 72 and two percentage control arms 74, one for each lose chute 73. The win output is not shown on FIG. 3.

Percentage control arms 74 can be automatically adjusted to three different positions depending on the targeted payout percentage. In the first position (not shown) both lose outputs 73 are open to allow for the free flow of coins to the cash box. The second position is partially open (i.e. one output open and one closed as shown in FIG. 3) and this will reduce the number of coins that can flow to the cash box. The third position has both outputs 73 closed which diverts all coins to the win output.

It is understood that preferred versions of the invention have been described above in order to illustrate how to make and use the invention. The invention is not intended to be limited to these versions, but rather is intended to be limited only by the claims set out below. Thus, the invention encompasses all alternate versions that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A coin-operated amusement machine comprising:

a. a play area whereupon coins are introduced, b. a first route for coins leaving the play area which coins are designated winning coins, c. a second route for coins leaving the play area which coins are designated losing coins, d. a loop wherein coins are circulated to and from the play area, e. an outlet for coins to be provided to the user as winning coins, and f. a diverter to divert the winning coins either to the loop or to the outlet.

2. The amusement machine of claim 1 further comprising means for determining the number of coins in the loop and controlling the diverter to divert winning coins to the outlet in order to reduce the number of coins in the loop.

3. The amusement machine of claim 1 wherein the diverter is able to divert the winning coins directly to the outlet.

4. The amusement machine of claim 3 further comprising means for determining the number of coins in the loop and controlling the diverter to divert winning coins to the outlet in order to reduce the number of coins in the loop.

5. The coin-operated amusement machine of claim 1 further comprising a coin entrance from which coins are directed substantially directly to the play area.

6. The coin-operated amusement machine of claim 1 further comprising:

a. a coin reservoir, b. a coin entrance from which coins are directed to the coin reservoir, c. means for determining the value of coins entered into the coin entrance, thereby calculating the credits available to the user, and d. an actuator operable by a user to direct coins equal to the value of the credits from the coin reservoir to the play area.

7. A coin-operated amusement machine comprising:

a. a play area whereupon coins are introduced, b. a first route for coins leaving the play area which coins are designated winning coins, c. a second route for coins leaving the play area which coins are designated losing coins, d. a loop wherein coins are circulated to and from the play area, and e. means for influencing the ratio of coins leaving the play area by the first and second routes.

8. The coin-operated amusement machine of claim 7 having two exits through which losing coins can leave the play area, each exit having a door for closing or opening the exit, so that both doors, one door or no doors can be open in order to influence the ratio of coins.

9. The coin-operated amusement machine of claim 7 wherein the means for influencing the ratio of coins fully or partially blocks the first or second route in order to increase the number of coins leaving the play area by means of the second or first route respectively.

10. The coin-operated amusement machine of claim 9 having two exits through which losing coins can leave the play area, each exit having a door for closing or opening the exit, so that both doors, one door or no doors can be open in order to influence the ratio of coins.

11. The coin-operated amusement machine of claim 7 further comprising a coin entrance from which coins are directed substantially directly to the play area.

12. The coin-operated amusement machine of claim 7 further comprising:

a. a coin reservoir, b. a coin entrance from which coins are directed to the coin reservoir, c. means for determining the value of coins entered into the coin entrance, thereby calculating the credits available to the user, and d. an actuator operable by a user to direct coins equal to the value of the credits from the coin reservoir to the play area.

13. A coin-operated amusement machine comprising:

a. a play area whereupon coins are introduced, b. a first route for coins leaving the play area which coins are designated winning coins, c. a second route for coins leaving the play area which coins are designated losing coins, d. a loop wherein coins are circulated to and from the play area, e. a coin reservoir, f. a counter wherein the number of winning coins is counted, and g. a diverter for diverting both winning and losing coins either to the loop or to the coin reservoir.

14. The coin-operated amusement machine of claim 13 further comprising a coin entrance from which coins are directed substantially directly to the play area.

15. The coin-operated amusement machine of claim 13 further comprising:

a. a coin entrance from which coins are directed to the coin reservoir, b. means for determining the value of coins entered into the coin entrance, thereby calculating the credits available to the user, and c. an actuator operable by a user to direct coins equal to the value of the credits from the coin reservoir to the play area.

16. A coin-operated amusement machine comprising:

a. a play area for coins, b. a coin reservoir, c. means for directing coins from the coin reservoir to the play area, d. a first coin entrance from which coins are directed substantially directly to the play area, e. a second coin entrance from which coins are directed to the coin reservoir, f. means for determining the value of coins entered into the second coin entrance, thereby calculating the credits available to the user, and g. an actuator operable by a user to direct coins equal to the value of the credits from the coin reservoir to the play area, wherein coins entered into the first coin entrance do not give the user any credits.

* * * * *